US008760836B2

(12) United States Patent
Hartmann et al.

(10) Patent No.: US 8,760,836 B2
(45) Date of Patent: Jun. 24, 2014

(54) METHOD AND CONTROL UNIT FOR CONTROLLING AN ELECTRICAL COMPONENT

(75) Inventors: Sven Hartmann, Stuttgart (DE); Harald Schueler, Backnang (DE); Stefan Tumback, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 161 days.

(21) Appl. No.: 13/522,246

(22) PCT Filed: Jan. 13, 2011

(86) PCT No.: PCT/EP2011/050366

§ 371 (c)(1),
(2), (4) Date: Nov. 9, 2012

(87) PCT Pub. No.: WO2011/086112

PCT Pub. Date: Jul. 21, 2011

(65) Prior Publication Data

US 2013/0049819 A1 Feb. 28, 2013

(30) Foreign Application Priority Data

| | | |
|---|---|---|
| Jan. 14, 2010 | (DE) | 10 2010 000 883 |
| Jan. 14, 2010 | (DE) | 10 2010 000 887 |
| May 21, 2010 | (DE) | 10 2010 029 231 |

(51) Int. Cl.

| | |
|---|---|
| ***H01H 47/00*** | (2006.01) |
| ***F02N 11/08*** | (2006.01) |
| *F02N 15/06* | (2006.01) |

(52) U.S. Cl.

CPC ..... *F02N 11/087* (2013.01); *F02N 11/0851* (2013.01); *F02N 15/067* (2013.01)

USPC ..... 361/139; 361/143

(58) Field of Classification Search

USPC ..... 361/139, 143, 160

See application file for complete search history.

(56) References Cited

U.S. PATENT DOCUMENTS

| | | | | |
|---|---|---|---|---|
| 3,441,810 | A | 4/1969 | Traina | |
| 5,909,352 | A | 6/1999 | Klabunde et al. | |
| 7,045,970 | B2 * | 5/2006 | Lecheler et al. | 315/274 |
| 8,023,572 | B2 * | 9/2011 | Hailey | 375/258 |

* cited by examiner

*Primary Examiner* — Danny Nguyen

(74) *Attorney, Agent, or Firm* — Kenyon & Kenyon LLP

(57) ABSTRACT

An electrical component having a primary winding, a first field-effect transistor, configured as a switch of the primary winding, for switching the primary winding, a quench winding for quenching the inductive load of the primary winding when switching off the primary winding, and a second field-effect transistor, configured as a switch of the quench winding, for switching the quench winding. In the process, the first field-effect transistor is operated in linear operation and the second field-effect transistor is operated in linear operation or in a clock-pulsed operation between the linear operation and a switched-off state during a switching-off process of the quench winding.

13 Claims, 3 Drawing Sheets

METHOD AND CONTROL UNIT FOR CONTROLLING AN ELECTRICAL COMPONENT

FIELD OF THE INVENTION

The present invention relates to the control of electrical components, such as relays, transformers or electromagnets which have an inductive load.

BACKGROUND INFORMATION

One example for such an electrical component is the switching relay and the engaging relay of a motor vehicle. Such a switching relay and/or engaging relay may be configured using a primary winding and a quench winding. In this context, the primary winding takes on the function of a pull-in winding for pulling in the engaging relay. The second winding is able to act in operation as the hold-in winding. For the purpose of switching both windings, a respective field-effect transistor is provided.

It is understood that an electrical component may have two coils, during the quenching of the magnetic flow, the energy being essentially carried by a field-effect transistor.

SUMMARY OF THE INVENTION

The exemplary embodiments and/or exemplary methods of the present invention are based on the recognition that the energy being released during the quenching should be distributed to at least two field-effect transistors, so that an overload of a single field effect transistor is avoided. Because the energy for quenching the coil current is able to be distributed to two field-effect transistors, the field effect transistors are able to be dimensioned in a smaller manner.

Furthermore, additional components for quenching the coil current may advantageously be omitted.

Accordingly, a method is provided for controlling an electrical component, having the following steps: providing the electrical component with a primary winding, a first field-effect transistor (FET), configured as a switch of the primary winding, for switching the winding, a quench winding for quenching the inductive load of the primary winding during the switching off of the primary winding, and a second field effect transistor (FET), configured as a switch of the quench winding, for switching the quench winding, and operating the first field-effect transistor in linear operation and the second field effect transistor in linear operation or in a clock-pulsed operation between the linear operation and a switched-off state during a switching-off process of the quench winding.

Furthermore, a control unit is provided for controlling an electrical component, the electrical component having a primary winding, a first field-effect transistor, configured as a switch of the primary winding, for switching the primary winding, a quench winding for quenching the inductive load of the primary winding when switching off the primary winding, and a second field effect transistor, configured as a switch of the quench winding, for switching the quench winding. In this instance, the control device is suitable for operating the first field-effect transistor in linear operation and the second field effect transistor in linear operation or in a clock-pulsed operation between the linear operation and a switched-off state during a switching-off process of the quench winding.

The control unit may be implemented using hardware technology or even hardware and software technology. In a hardware technology implementation, the control unit may be configured as a device, for instance, as a microprocessor, as a device or even as part of a system, such as of an automobile control unit. In a hardware and software technology implementation, the control unit may be configured as a computer program product, as a function, as a routine, as a part of a program code or as an executable object.

Furthermore, an electric component is provided, having a control unit as described above.

The electrical component may be a switching relay and/or an engaging relay of a motor vehicle.

Moreover, a starter or starter system is provided, having one or more of such an electrical component.

Advantageous further developments and embodiments of the method described herein and the control unit described herein are found in the further descriptions herein.

According to a further refinement, the field-effect transistor is operated in the linear operation and the second field effect transistor is operated in the linear operation or in the clock-pulsed operation during the switching-off process of the quench winding after the quenching of the primary winding and before the switching off of the quench winding. Consequently, the energy becoming released during the quenching of the primary winding may be distributed to the two field-effect transistors, without fear of destruction of one of the field effect transistors during the switching off of the quench winding.

According to one additional refinement, the field-effect transistor and the second field-effect transistor are operated in linear operation during the switching off process.

The two transition resistances or drain/source resistances of the two field-effect transistors, in this instance, may be able to be controlled in such a way that the input of the switching off energies during the entire switching off process is the same in both field effect transistors.

According to another refinement, the first field-effect transistor and the second field effect transistor are activated during the switching off process in such a way that the drain/source resistors of the first field-effect transistor and of the second field-effect transistor are configured so that they may be equal during the switching off process as to the energy contributions removed from the two field effect transistors.

According to still another refinement, the first field-effect transistor is operated in the linear operation, and the second field effect transistor is operated in the clock-pulsed operation, using a certain drain/source resistor during the switching off process.

In this context, the clock pulse of the clock pulse operation may be set so that the magnetic flux is reduced uniformly and the flows through the primary winding and the quench winding are lowered continuously. Thus it is advantageously avoided that the currents are able to increase again.

According to yet another further development, the clock-pulsed operation has pulses and pulse pauses for the linear operation. Consequently, in an advantageous manner, a fixed pulse duty factor does not necessarily have to be specified.

This may be used particularly advantageously especially if, based on a certain wiring configuration of the field effect transistors, only a certain transition resistance or source/drain resistance is able to be set.

According to one embodiment of the control unit, it is equipped to operate the electrical component in an operating state having a switched-on first field-effect transistor and a switched-off second field-effect transistor, in a quenching state having a switched-off first field effect transistor and switched-on second field effect transistor, in a switched-off state having the first field-effect transistor in linear operation and the second field effect transistor in linear operation or a clock-pulsed operation and, in an at-rest condition, having a switched-off first field-effect transistor and a switched off field-effect transistor. In order to set the operating state, the quenching state, the switched off state and the at-rest state, the control unit is advantageously configured to activate the first FET using a first control signal and the second FET using a second control signal.

In both cases of the operation of the second FET during the switching off process, namely in the linear operation or the clock-pulsed operation, the effect according to the exemplary embodiments and/or exemplary methods of the present invention is based on the idea that, by switching on the primary winding before switching off the quench winding, current from the quench winding is transmitted to the primary winding. The switch off energy is thereby distributed to the two FET's. In particular, if the transition resistance of the first FET is not sufficiently small for the primary winding, the effect is able to be amplified by a brief switching off of the quench winding.

Additional exemplary embodiments of the present invention are illustrated in the drawings and explained in greater detail in the following description.

DETAILED DESCRIPTION

Figure 1:
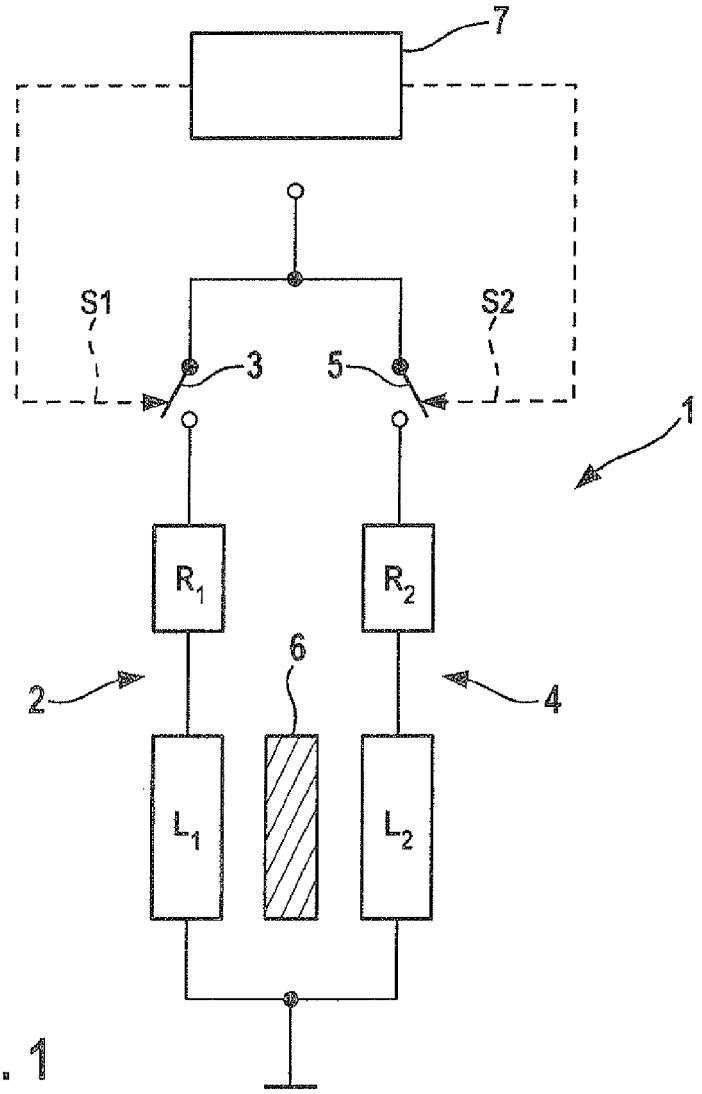
FIG. 1 shows a schematic block diagram of a component according to the present invention.

FIG. 1 shows a schematic block diagram of a component 1 according to the present invention.

Component 1 according to the invention has a primary winding 2, a first FET 3, a quench winding 4, a second FET 5 and a core 6. Primary winding 2 has a predetermined inductance $L_1$, a resistance $R_1$ and a predetermined number of turns $n_1$. Analogously, quench winding 3 has a predetermined inductance $L_2$, a predetermined resistance $R_2$ and a predetermined number of turns $n_2$. Primary winding 2 and quench winding 4 are situated around a common core 6, especially wound. First FET 3 is equipped as a switch to switch primary winding 2. Furthermore, second FET 5 is equipped as a switch for switching quench winding 4. Quench winding 4 is particularly equipped for quenching the inductive load of primary winding 2 during switching off primary winding 2.

Component 1 also has a control unit 7. Control unit 7 is equipped to operate first FET 3 in linear operation 8 and second FET 5 in linear operation 8 or in a clock-pulsed operation 10 between linear operation 8 and a switched off state 9 during a switch-off process 12 of quench winding 4 (see FIGS. 4 and 6).

First FET 3 may be operated in linear operation 8, and second FET 5 in linear operation 8 or in clock-pulsed operation 10 during switch off process 12 of quench winding 4 after the quenching process of primary winding 2 and before switching off of quench winding 4. For this, the control unit controls first FET 3 using a first control signal $S_1$ and second FET 5 using a second control signal $S_2$.

Figure 2:
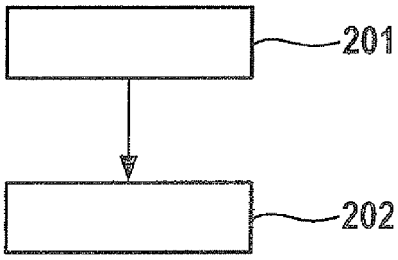
FIG. 2 shows a schematic flow chart of a first exemplary embodiment of the method according to the present invention.

Furthermore, FIG. 2 shows a schematic flow chart of a first exemplary embodiment of the method according to the present invention.

The exemplary embodiment of FIG. 2 has method steps 201 and 202, and is described with reference to FIG. 1. In method step 201, electronic component 1 is provided having a primary winding 2, a first FET 3 configured as a switch of primary winding 2 for switching primary winding 2, a quench winding 4 for quenching the inductive load of primary winding 2, and a second FET 5 configured as a switch of quench winding 4 for switching quench winding 4.

In method step 202, first FET 3 is operated in linear operation 8 and second FET 5 in linear operation 8 or in a clock-pulsed operation 10 between linear operation 8 and a switched off state 9 during a switch off process 12 of quench winding 4. Switching off process 12 lies after quenching process 11 and before the time of the actual switching off 13 of the two FET's 3 and 5 (see FIGS. 4 and 6).

Figure 3:
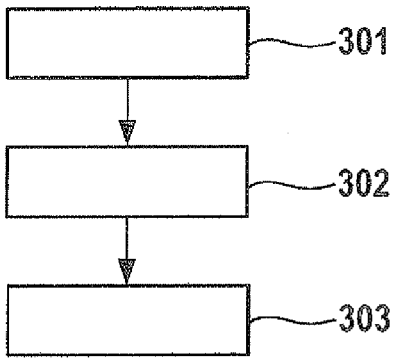
FIG. 3 shows a schematic flow chart of a second exemplary embodiment of the method according to the present invention.
Figure 4:
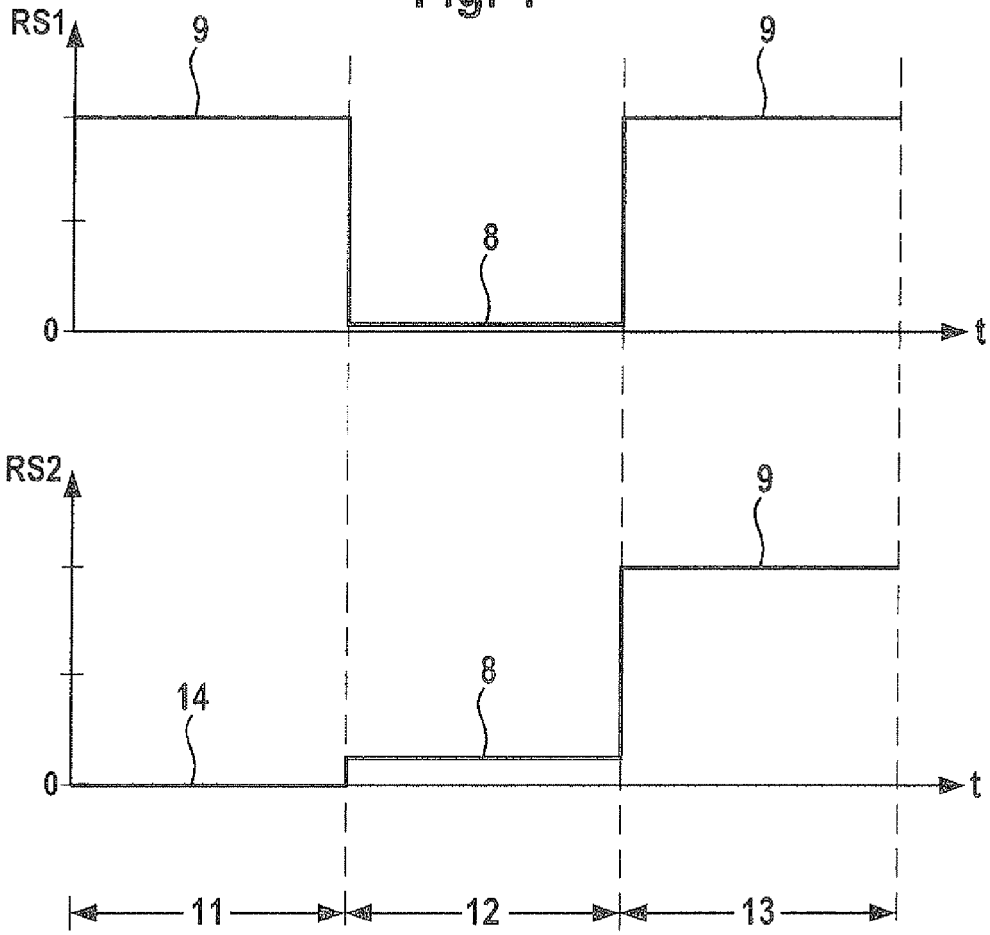
FIG. 4 shows the curve over time of the drain/source resistance of the first FET and of the second FET in the method according to FIG. 3.

FIG. 3 shows a schematic flow chart of a second exemplary embodiment of a method according to the present invention. The exemplary embodiment of FIG. 3 has method steps 301 to 303, and is described with reference to FIG. 4. FIG. 4 shows a curve over time of drain/source resistors RS1 and RS2 of first FET 3 and second FET 5 in the method according to FIG. 3. In this instance, time axis t of FIG. 4 is subdivided into quenching state 11, switching off state 12 and at-rest state 13 of component 1.

In method step 301, component 1 is operated in quenching state 11. In quenching state 11, first FET 3 is in a switched off state 9, that is, drain/source resistor RS1 is highly resistive. Moreover, in quenching state 11, second FET 3 is in a switched on state 14, that is, drain/source resistor RS2 is low-resistive, so that the energy becoming released during the switching off of primary winding 2 is able to be quenched via quench winding 4. This is particularly denoted as a hold.

In method step 302, component 1 is operated in switch-off state 12. In this case, first FET 3 is operated in linear operation 8. Second FET 5 is also operated in linear operation 8.

In method step 303, electrical component 1 is operated in an at-rest state 13, that is, both FET's 3 and 5 are in switched off state 9.

Figure 5:
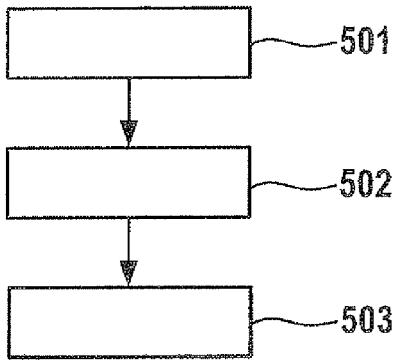
FIG. 5 shows a schematic flow chart of a third exemplary embodiment of the method according to the present invention.
Figure 6:
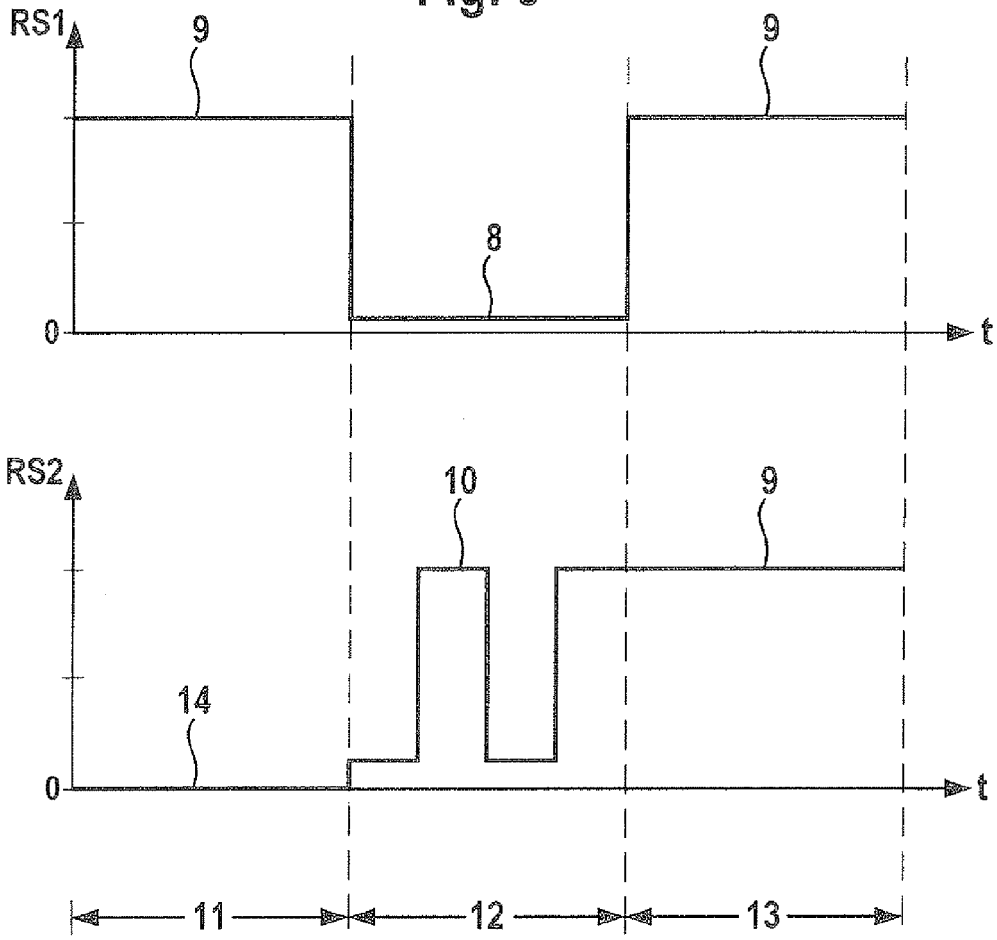
FIG. 6 shows the curve of the drain/source resistances of the first FET and of the second FET in the method according to FIG. 5.

FIG. 5 shows a schematic flow chart of a third exemplary embodiment of a method according to the present invention. The exemplary embodiment of FIG. 5 has method steps 501 to 503, and is described with reference to FIG. 6. FIG. 6 shows a curve over time of drain/source resistors RS1 and RS2 of first FET 3 and second FET 5 in the method according to FIG. 5. In this instance, time axis t of FIG. 6 is also subdivided into quenching state 11, switching off state 12 and at-rest state 13 of component 1.

In method step 501, component 1 is operated in quenching state 11. In quenching state 11, first FET 3 is in a switched off state 9, that is, drain/source resistor RS1 is highly resistive. Furthermore, in quenching state 11, second FET 3 is in a switched on state 14, that is, drain/source resistor RS2 is low-resistive. This is particularly denoted as a hold.

In method step 502, component 1 is operated in switched-off state 12. Consequently, first FET 3 is operated in linear operation 8. Moreover, second FET 5 is operated in clock-pulsed operation 10. In clock-pulsed operation 10, alternating switching back and forth is performed between linear operation 8 and a switched off state 9.

In method step 503, electrical component 1 is operated in at-rest state 13, that is, both FET's 3 and 5 are in switched off state 9

What is claimed is:

1. A method for controlling an electrical component, comprising:

operating a first field-effect transistor in a linear operation and a second field-effect transistor in one of a linear operation and a clock-pulsed operation between the linear operation and a switched off state during a switching-off process of a quench winding;

wherein the electrical component includes a primary winding, the first field-effect transistor, configured as a switch of the primary winding, for switching the primary winding, the quench winding for quenching an inductive load of the primary winding when switching off the primary winding, and the second field effect transistor, configured as a switch of the quench winding, for switching the quench winding.

2. The method of claim 1, wherein the first field-effect transistor is operable in the linear operation and the second field-effect transistor is operable in one of the linear operation and the clock-pulsed operation during the switch-off process after the quenching of the primary winding and before switching off the quench winding.

3. The method of claim 1, wherein the first field-effect transistor and the second field-effect transistor are operated in the linear operation during the switching off process.

4. The method of claim 3, wherein the first field-effect transistor and the second field-effect transistor are controlled during the switching-off process so that the drain/source resistors of the first field-effect transistor and the second field-effect transistor are configured so that the energies removed during the switching-off process via the two field-effect transistors are essentially the same.

5. The method of claim 1, wherein the first field-effect transistor is operated in the linear operation and the second field-effect transistor is operated in the clock-pulsed operation using a certain drain/source resistor during the switching-off process.

6. The method of claim 1, wherein the first field-effect transistor is operated in the linear operation and the second field-effect transistor is operated in the clock-pulsed operation using a certain drain/source resistor during the switching-off process, the clock pulse of the clock-pulsed operation being set so that the magnetic flux is reduced uniformly and the currents through the primary winding and the quench winding drop off continuously.

7. The method of claim 6, wherein the clock-pulsed operation has pulses and pulse pauses for the linear operation.

8. A control unit for controlling an electrical component, comprising:

a control arrangement to control a first field-effect transistor in a linear operation and a second field-effect transistor in one of a linear operation and a clock-pulsed operation between the linear operation and a switched off state during a switching-off process of a quench winding;

wherein the electrical component includes a primary winding, the first field-effect transistor, configured as a switch of the primary winding, for switching the primary winding, the quench winding for quenching an inductive load of the primary winding when switching off the primary winding, and the second field effect transistor, configured as a switch of the quench winding, for switching the quench winding.

9. The control unit of claim 8, wherein the control arrangement is configured to operate the electrical component in an operating state having a switched on first field-effect transistor and a switched off second field-effect transistor, in a quenching state having a switched off first field-effect transistor and a switched on second field-effect transistor, in a switched-off state having the first field effect transistor in the linear operation and the second field effect transistor in the linear operation or in a clock-pulsed operation and in an at-rest state having a switched-off first field-effect transistor and a switched off second field-effect transistor.

10. The control unit of claim 9, wherein the control arrangement, to set the operating state, the quenching state, the switching off state and the at-rest state, activates the first field-effect transistor using a first control signal and the second field-effect transistor using a second control signal.

11. An electrical component, comprising:

a control unit for controlling an electrical component, including a control arrangement to control a first field-effect transistor in a linear operation and a second field-effect transistor in one of a linear operation and a clock-pulsed operation between the linear operation and a switched off state during a switching-off process of a quench winding;

wherein the electrical component includes a primary winding, the first field-effect transistor, configured as a switch of the primary winding, for switching the primary winding, the quench winding for quenching an inductive load of the primary winding when switching off the primary winding, and the second field effect transistor, configured as a switch of the quench winding, for switching the quench winding.

12. The electrical component of claim 11, wherein the electrical component is configured as switching relay and an engaging relay of a starter of a motor vehicle.

13. A starter, comprising:

an electric component, including:

a control unit for controlling an electrical component, including a control arrangement to control a first field-effect transistor in a linear operation and a second field-effect transistor in one of a linear operation and a clock-pulsed operation between the linear operation and a switched off state during a switching-off process of a quench winding;

wherein the electrical component includes a primary winding, the first field-effect transistor, configured as a switch of the primary winding, for switching the primary winding, the quench winding for quenching an inductive load of the primary winding when switching off the primary winding, and the second field effect transistor, configured as a switch of the quench winding, for switching the quench winding.

* * * * *